US005836017A

United States Patent [19]

Hironaga et al.

[11] Patent Number: 5,836,017

[45] Date of Patent: Nov. 17, 1998

[54] CORSAGE ASSEMBLY AND COMBINATION THEREOF WITH CLOTHING

[76] Inventors: Saburo Hironaga, 2910 W. Lingan La., Santa Ana, Calif. 92704; Taylor Rudd, 17932 Scotia Cir., Huntington Beach, Calif. 92647

[21] Appl. No.: 784,710

[22] Filed: Jan. 16, 1997

[51] Int. Cl.[6] ..... A41D 1/12; A45F 5/08

[52] U.S. Cl. ..... 2/69; 2/1; 2/244; 24/5; 24/6; 24/711.3; 428/11; 428/23

[58] Field of Search ..... 2/244, 246, 1, 2/69; 24/5, 460, 462, 6, 114.05, 114.4, 104, 93, 710, 706.4, 711.2, 711.3; 428/7, 17, 23, 27

[56] References Cited

U.S. PATENT DOCUMENTS

| | | | |
|---|---|---|---|
| 174,364 | 2/1876 | Hurdle . | |
| D. 334,905 | 4/1993 | Ritz . | |
| 1,488,841 | 4/1924 | Scott | 24/711.2 |
| 1,557,506 | 10/1925 | Walthers | 24/5 |
| 2,145,531 | 1/1939 | Shuko . | |
| 3,134,151 | 5/1964 | Conlin | 24/6 |
| 3,416,195 | 12/1968 | Borthwick | 24/5 |
| 3,735,447 | 5/1973 | Abraham . | |
| 4,229,877 | 10/1980 | Fagan . | |

*Primary Examiner*—Gloria M. Hale

*Attorney, Agent, or Firm*—Oppenheimer Poms Smith

[57] ABSTRACT

A corsage mounting device including a small wire element having two ends. Each end having buttons with holes wherein the wire ends are inserted therein in order to attach the corsage to a wearer's garment.

12 Claims, 2 Drawing Sheets

CORSAGE ASSEMBLY AND COMBINATION THEREOF WITH CLOTHING

BACKGROUND OF THE INVENTION

It has been, for at least many decades, conventional to use long straight pins for mounting corsages onto dresses, etc. This has occasionally given rise to "jokes" about the stabbing by the pins—especially during the mounting procedure—of women wearing the dresses. However, the matter is, in fact, not at all funny. Not only can painful injury occur, but even in the best of circumstances, the corsage is not mounted as safely or easily or stably as desired.

Over at least several decades, attempts have been made to achieve replacements for the conventional long straight corsage-mounting pins. The resulting devices are not known by the present inventors to have achieved commercial success. There is, the present inventors believe, a primary reason why the conventional corsage pins have not been rendered obsolete. That primary reason is cost. It is from a practical commercial standpoint of massive importance that the devices on which the corsages are mounted by florists be not only practical and satisfactory but very cheap.

Although price is the primary thing, it is emphasized that stability, ease of use, and safety are also of large importance. The corsage must not flop or pivot relative to the device on which it is mounted. And, the positioning of the corsage assembly—including the mounting device—on the dress must be doable with ease. Lastly, but importantly, the device must not be likely to injure the wearer.

SUMMARY OF THE INVENTION

A single integral piece of wire has a relatively long body and relatively short bent legs. The body and legs combine to form a generally U-shaped configuration when viewed from the side.

The wire forming the body is bent generally in a plane that is generally transverse to the legs. Stated more definitely, at least a substantial part of the body is bent into zigzag or serpentine configuration. The stems of the flowers forming the corsage are placed along this bent region, and florist's tape is wrapped around the stems and bent region. The bent region and the tackiness of the tape combine to prevent the stems from pivoting substantially relative to the body. Thus, when the legs are anchored to a dress, etc., the stems and thus the flowers do not normally pivot or flop substantially relative to the dress.

To anchor the legs to a dress, etc., the legs are caused to have sharply pointed ends that pass inwardly through the dress but only a short distance. Synthetic resin anchor "buttons" having axial holes are pressed over the leg ends inwardly of the dress. The relationships are such that the leg ends do not penetrate all the way through the buttons. The buttons cling to the legs by friction and/or resiliency, thereby maintaining the legs in inserted condition and preventing the leg ends from contacting the woman. In the great majority of situations, the buttons press against the inner surface of the dress while the combination body, stems, and tape press against the outer surface thereof; accordingly, prevention of pivoting of the legs and connected parts relative to the dress is promoted.

Although the body of the wire is "relatively" long, and the legs are "relatively short", the overall wire is small. It is combined with a dress, or other article of clothing, not with anything else. The distance between the legs ranges from about 2½ inches to about 1½ inches in different ones of the devices.

The diameter of the wire is sufficiently large to prevent major flexibility of the wire, but sufficiently small to prevent damage to a typical dress (etc.)—forming fabric. A typical diameter is 3/64 inch.

DETAILED DESCRIPTION OF THE PREFERRED EMBODIMENT

The word "corsage", as used in this specification and claims, denotes one or more natural and/or artificial flowers. The stems of such flowers (when there is more than one) are parallel to and adjacent each other, so as to be mountable on the present wire by a wrapping of conventional florist's tape.

Figure 2:
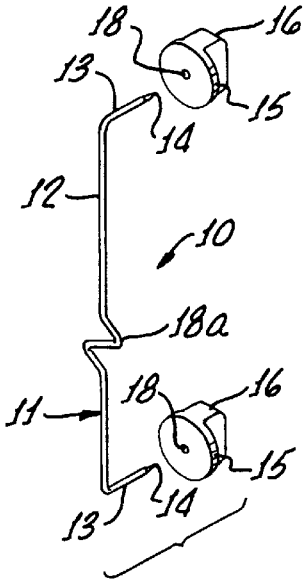
FIG. 2 is an isometric view illustrating one wire assembly, having a relatively long body.
Figure 3:
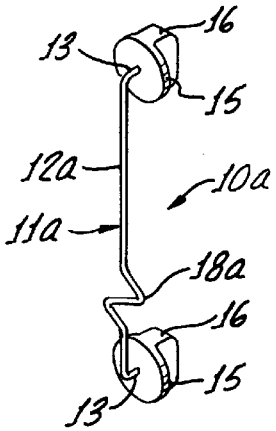
FIG. 3 and FIG. 4 are isometric views corresponding generally to FIG. 1 but where the bodies of the wires are less long.
Figure 4:
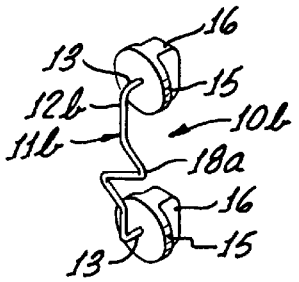

The corsage-mounting device of the present invention is indicated in FIGS. 2–4 by the reference character 10, 10*a* and 10*b*, respectively. These figures show examples having different body lengths.

Each device 10, 10*a* and 10*b* comprises an integral unitary one-piece wire 11, 11*a* and 11*b* indicated in such FIGS. 2–4. Each of the wires is generally U-shaped, having an elongate body 12 (and 12*a* and 12*b*) and the parallel legs 13.

Although the illustrated bodies 12, 12*a* and 12*b* are progressively less long in the respective FIGS. 2–4, the legs 13 are preferably the same relatively short length. Each leg in each figure has a sharp point thereon, numbered 14 in FIG. 2.

The preferred length of body 12 is 2½ inches; that of body 12*a* 2 inches; and that of body 12*b* 1½ inches. The leg length is preferably ¼ inch. Each body-and-leg combination is made of steel wire having a diameter of, preferably, 3/64 inch. Thus, the florist may easily store large numbers of the three sizes of wires (11, 11*a* and 11*b*) in three boxes. There may also be some other sizes, stored in other boxes, but all sizes are not large--being all adapted to be mounted unobtrusively on a woman's dress.

The remaining component of each device 10, 10*a* and 10*b* is a synthetic resin "button" 15. These are small, preferably having a diameter of 5/16 inch, and large numbers thereof are easily stored in a box. All are, preferably, identical for all devices 11, 11*a*, 11*b* and others.

Each button 15 is a disc having a planar face adapted to engage the fabric of the dress. On the side of the disc remote from such planar face is a handle portion 16 having flat parallel sides 17 (FIG. 6) adapted to be held (by compression) between two fingers of a person mounting the device on a dress.

A central hole 18 (FIG./ 2) is provided in each button 15 and its handle portion 16. Such hole is a blind "passage" extending toward and into the handle 16 from the planar dress-side face of button 15.

The buttons 15 and handles 16 are integral with each other, and are preferably composed of somewhat soft, flexible synthetic resin. Hole 18 has a diameter about equal or somewhat smaller than the leg diameter. Accordingly, and because the synthetic resin is not so soft that it does not have significant hoop strength around the legs, the buttons "grasp" and cling to the legs, holding the devices 10, 10*a* and 10*b* in mounted condition on a dress. In no realistic event can a leg penetrate all the way through a combination button/handle 15/16 when the device is mounted on a typical dress. Accordingly, the woman will not be contacted by the points 14.

Each body 12, 12*a* and 12*b* is substantially bent as shown at 18*a* in FIGS. 2–4; preferably in a plane that is perpendicular to legs 13. The illustrated bend is a single "cycle" of V-shaped "wave" so that there is one point or peak spaced from the longitudinal axis of the body. As an example, each point of peak is spaced ⅛ inch from such longitudinal axis. The dimension of such wave, in a direction longitudinal to the body, is, in the example, ¼ inch. There may be more than one V bend adjacent or spaced from each other.

The bent portion 18*a* keeps the florist's tape, and the flower stems and flowers, from rotating or pivoting relative to each body 11, 11*a* or 11*b*.

Description of the Remaining Portions of the Combination, and of Assembly, and of Mounting on a Dress, Etc.

When the florist receives an order for a particular corsage, he or she selects the size of wire element 11, 11*a* or 11*b* (or other similar size) that is appropriate to the particular flowers. Then, the wire 11, 11*a* or 11*b* is disposed parallel to and adjacent the stems of the flowers. Alternatively, the wire 11, 11*a* or 11*b* may be mounted in a jig on a table, and the stems positioned adjacent body 12, 12*a* or 12*b*. One such jig consists of two vertical pipes having small vertical holes therein, at their upper ends, that are barely large enough to receive legs 13. These pipes are anchored on a table (in a base) in spaced-apart relationship—the spacing being such that both legs (of each size body) may be received simultaneously therein.

Figure 6:
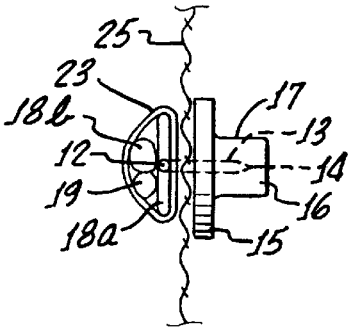
FIG. 6 is a horizontal sectional view on line 6—6 of FIG. 5, showing a leg piercing the dress of the woman wearing the present assembly.

As shown in FIG. 6, the stems 18*b*, 19 and the petals 20 and 21 of the flowers are disposed on the side of wire 11, 11*a* or 11*b* that is remote from the legs 13.

Figure 5:
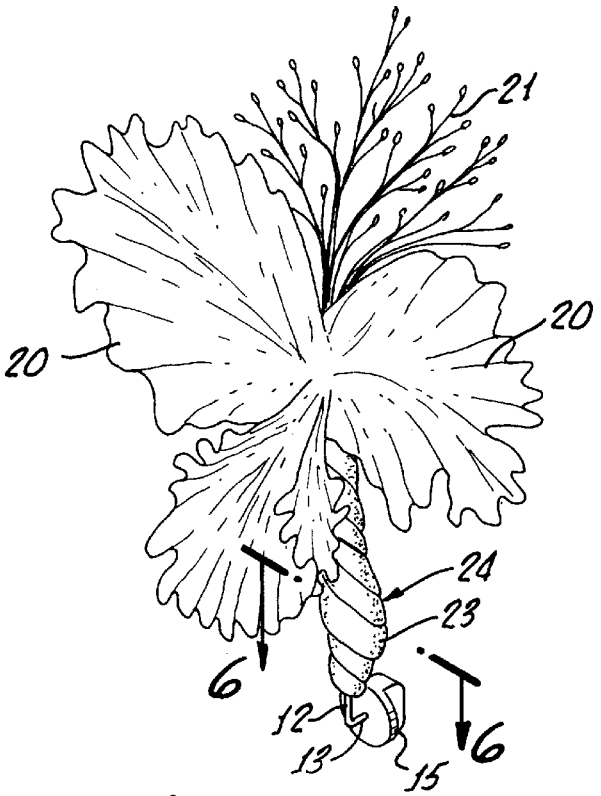
FIG. 5 is an isometric view of an assembled corsage, wire, florist's tape, and buttons.

Then, florist's tape 23 is wrapped around the wire body 11, 11*a* or 11*b*—preferably in helical manner to form the helix 24 shown in FIG. 5. The tape is green and paper-like, with an interior tacky surface, and cooperates with the bent portion 18*a* and the remainder of the body to hold the flowers firmly in place. Such tape may be obtained from Shinoda Design Center under the trade name "GREEN FLORAL TAPE", such Center having an address at 1000 So. Grand Avenue, Santa Ana, Calif. 92705.

The florist then takes two buttons 15 from their box, and mounts them on legs 13, completing the corsage assembly. From that time on, and when the corsage is handed to the woman who will wear it, the points 14 are covered by the buttons 15 so that the woman (and others) are protected from injury.

Figure 1:
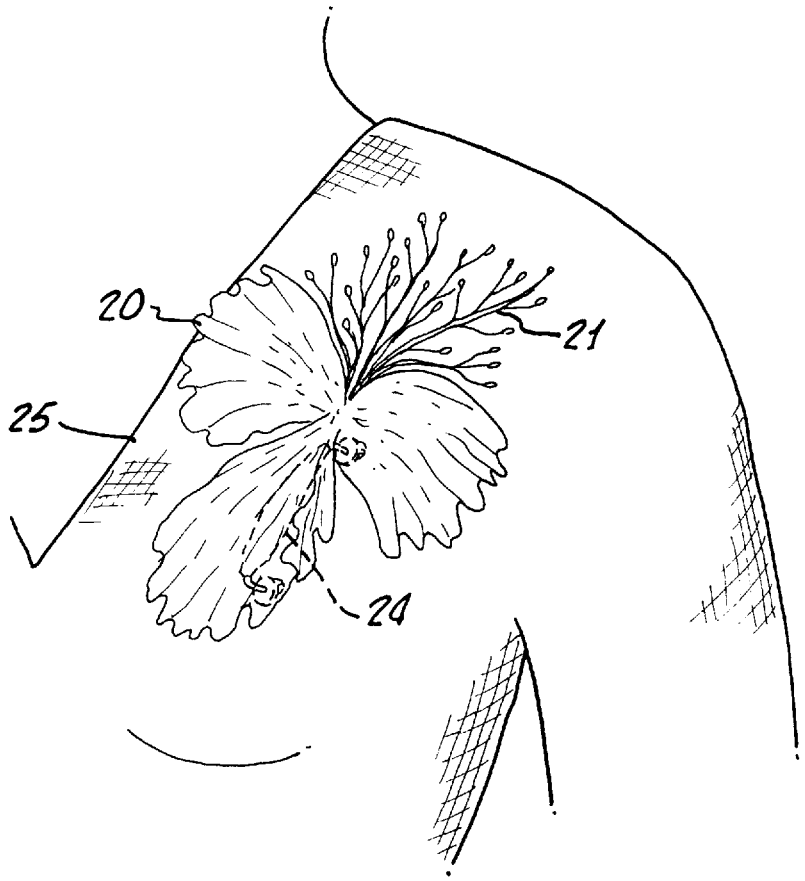
FIG. 1 is an isometric view showing the present combination mounted on a woman, a neck and shoulder region of the woman being shown.

When the woman is ready to wear the corsage assembly, she removes the two buttons 15 and inserts the points 14 and legs 13 inwardly through the cloth 25 (FIGS. 1 and 6) of her dress (FIG. 1). This she does by holding the dress away from her skin with one hand, while inserting the legs 13 with the other. She immediately replaces the buttons 15 on the legs 13 but on the inside of her dress. She pushes the buttons outwardly until the inside surface of cloth 25 is contacted, as shown in FIG. 6. At the same time, the portion of florist's tape helix 23 that is adjacent the back of bent portion 18*a* is adjacent the outside surface of cloth 25.

Thus, the present corsage-mounting device is not only combined with corsage and tape to form the corsage assembly, but also combined with the dress, etc.

There is safety because legs 13 are short and are covered. There is stability because of bent region 18*a* and because the dress is contacted by tape adjacent to it. The buttons firmly grip the legs to keep the corsage from coming off. There is ease of mounting because pushing the short legs through the fabric, and mounting the buttons, is much easier than inserting a long straight pin in the conventional manner.

The foregoing detailed description is to be clearly understood as given by way of illustration and example only, the spirit and scope of this invention being limited solely by the appended claims.

What is claimed is:

1. A combination corsage-mounting device, corsage, and woman's outer garment, which comprises:

(a) a corsage-mounting device, said device including a small wire element having an elongate wire body and having wire legs extending from said body transverse to said body, said wire legs having ends remote from said body, said ends of said wire legs being pointed, said wire legs having end portions that include said ends, said device also including buttons having holes therein to receive and hold said end portions of said legs, (b) a corsage having stem means disposed parallel to and adjacent said body;

(c) means to secure said stem means to said body, and (d) a dress or other woman's outer garment formed of a fabric, said fabric having an outer surface, said body, corsage, and securing means being on the exterior of said garment and adjacent said outer surface of said fabric, said legs penetrating through said fabric in an inward direction, said buttons being on the interior of said garment and mounted on said end portions of said legs to cover said pointed ends and prevent said wire element from moving outwardly away from said fabric.

2. The invention as claimed in claim 1, in which said wire body and wire legs are integral and unitary with each other, having been formed from a single piece of wire and not joined together.

3. The invention as claimed in claim 1, in which the length of said body is less than about 2½ inches.

4. The invention as claimed in claim 1, in which the length of each of said legs is less than about ¼ inch.

5. The invention as claimed in claim 1, in which the length of said body is less than about 2½ inches, and in which the length of each of said legs is less than about ¼ inch.

6. The invention as claimed in claim 1, in which said means to secure said stem means to said body is a wrapping of florist's tape.

7. The invention as claimed in claim 1, in which said body has a bent portion adapted to prevent said securing means (c) from moving relative to said body.

8. The invention as claimed in claim 7, in which said bent portion is a wave.

9. The invention as claimed in claim 8, in which said bent portion is transverse to said legs.

10. The invention as claimed in claim 6, in which said body has a bent portion adapted to prevent said tape from moving relative to said body.

11. The invention as claimed in claim 7, in which said bent portion is a wave.

12. The invention as claimed in claim 10, in which said body is transverse to said legs.

* * * * *